US007163383B2

(12) United States Patent
Skinner

(10) Patent No.: US 7,163,383 B2
(45) Date of Patent: Jan. 16, 2007

(54) COMPRESSOR HAVING ALIGNMENT BUSHINGS AND ASSEMBLY METHOD

(75) Inventor: Robin G Skinner, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 672 days.

(21) Appl. No.: 10/657,309

(22) Filed: Sep. 8, 2003

(65) Prior Publication Data

US 2004/0057837 A1 Mar. 25, 2004

Related U.S. Application Data

(60) Provisional application No. 60/412,868, filed on Sep. 23, 2002.

(51) Int. Cl.
*F04B 17/03* (2006.01)
*B23P 15/00* (2006.01)

(52) U.S. Cl. ..... 417/410.5; 29/447; 29/888.022

(58) Field of Classification Search ..... 417/410.5, 417/423.1; 29/407.1, 407.09, 447, 888.02, 29/888.022

See application file for complete search history.

(56) References Cited

U.S. PATENT DOCUMENTS

| | | | | |
|---|---|---|---|---|
| 2,661,172 A | | 12/1953 | Needham | 248/19 |
| 2,911,709 A | * | 11/1959 | Boynton | 29/447 |
| 3,039,725 A | | 6/1962 | Kerley, Jr. | 248/20 |
| 3,050,832 A | * | 8/1962 | Scheldorf | 29/447 |
| RE25,569 E | | 5/1964 | Coron et al. | |
| 3,145,960 A | | 8/1964 | Langdon | 248/13 |
| 3,749,340 A | | 7/1973 | Williams et al. | 248/24 |
| 3,785,167 A | | 1/1974 | Sahs | 62/296 |
| 4,089,613 A | | 5/1978 | Babbitt, Jr. | |
| 4,244,680 A | | 1/1981 | Ishizuka et al. | 418/97 |
| 4,389,171 A | | 6/1983 | Eber et al. | 418/15 |
| 4,416,594 A | | 11/1983 | Ichikawa | 417/360 |
| 4,497,615 A | | 2/1985 | Griffith | 417/310 |
| 4,518,276 A | | 5/1985 | Mitchell et al. | |
| 4,552,518 A | | 11/1985 | Utter | 418/55 |
| 4,557,677 A | | 12/1985 | Hasegawa | 418/63 |
| 4,685,188 A | | 8/1987 | Goy | |
| 4,767,293 A | | 8/1988 | Caillat et al. | 418/55 |
| 4,792,288 A | | 12/1988 | Gromoll et al. | 417/278 |
| 4,818,198 A | | 4/1989 | Tamura et al. | 418/55 |
| 4,877,382 A | | 10/1989 | Caillat et al. | 418/55 |
| 4,992,033 A | | 2/1991 | Caillat et al. | 418/55.3 |

(Continued)

FOREIGN PATENT DOCUMENTS

FR 2 755 477 A1 11/1997

(Continued)

*Primary Examiner*—Michael Koczo, Jr.
(74) *Attorney, Agent, or Firm*—Baker & Daniels LLP

(57) ABSTRACT

A compressor assembly including a compression mechanism having a main bearing and a plurality of first pilot holes, and an electric motor comprising a rotor disposed within a stator. The stator has a plurality of second and third pilot holes. Each of the first pilot holes are aligned with one of the second pilot holes. Alignment members are disposed within each pair of aligned first and second pilot holes, whereby the alignment of compression mechanism and stator is maintained. An outboard bearing is secured to the stator, has a plurality of fourth pilot holes and rotatably supports the drive shaft. Each of third pilot holes is aligned with one of the fourth pilot holes. Alignment members are disposed within each pair of third and fourth pilot holes, whereby the alignment of the compression mechanism, the stator and the outboard bearing is maintained.

19 Claims, 5 Drawing Sheets

U.S. PATENT DOCUMENTS 5,012,896 A 5/1991 Da Costa ..... 184/6.16
5,055,010 A 10/1991 Logan ..... 417/410
5,062,779 A 11/1991 Da Costa ..... 418/270
5,110,268 A 5/1992 Sakurai et al. ..... 417/410
5,114,322 A 5/1992 Caillat et al. ..... 418/55.6
5,137,437 A 8/1992 Machida et al. ..... 418/55.1
5,176,506 A 1/1993 Siebel ..... 417/368
5,211,031 A 5/1993 Murayama et al. ..... 68/498
RE34,297 E 6/1993 Elson ..... 417/372
5,219,281 A 6/1993 Caillat et al. ..... 418/55.6
5,222,885 A * 6/1993 Cooksey ..... 418/96
5,224,845 A 7/1993 Mangyo et al. ..... 417/423.13
5,240,391 A 8/1993 Ramshankar et al. ... 417/410 R
5,247,738 A 9/1993 Yoshii
5,290,160 A * 3/1994 Ito et al. ..... 29/888.022
5,312,234 A 5/1994 Yoshii
5,345,785 A 9/1994 Sekigami et al. ..... 62/468
5,345,970 A 9/1994 Leyderman et al. ..... 137/856
5,346,375 A 9/1994 Akiyama et al. ..... 418/15
5,348,455 A * 9/1994 Herrick et al. ..... 418/63
5,354,184 A * 10/1994 Forni ..... 417/410.5
5,370,156 A 12/1994 Peracchio et al. ..... 137/856
5,391,066 A 2/1995 Sawai et al. ..... 418/55.6
5,411,384 A * 5/1995 Bass et al. ..... 29/888.022
5,427,511 A 6/1995 Caillat et al. ..... 418/55.1
5,474,433 A 12/1995 Chang et al. ..... 418/55.4
5,487,648 A 1/1996 Alfano et al. ..... 417/312
5,522,715 A 6/1996 Watanabe et al. ..... 418/55.1
5,531,577 A 7/1996 Hayase et al. ..... 418/55.1
5,533,875 A 7/1996 Crum et al. ..... 417/368
5,579,651 A 12/1996 Sugiyama et al. ..... 62/469
5,580,233 A 12/1996 Wakana et al. ..... 418/94
5,588,819 A * 12/1996 Wallis ..... 29/888.022
5,597,293 A 1/1997 Bushnell et al. ..... 417/410.3
5,597,296 A 1/1997 Akazawa et al. ..... 418/55.1
5,634,781 A 6/1997 Yoshida et al.
5,645,408 A 7/1997 Fujio et al. ..... 418/55.4
5,660,539 A 8/1997 Matsunaga et al. ..... 418/55.6
5,683,237 A 11/1997 Hagiwara et al. ..... 418/55.2
5,695,326 A 12/1997 Oka et al. ..... 418/55.1
5,716,202 A 2/1998 Koyama et al. ..... 418/55.6
5,720,601 A 2/1998 Tark et al. ..... 417/569
5,745,992 A 5/1998 Caillat et al. ..... 29/888.022
5,752,688 A 5/1998 Campbell et al. ..... 248/674
5,769,126 A 6/1998 Cho ..... 137/856
5,772,411 A 6/1998 Crum et al. ..... 417/368
5,772,416 A 6/1998 Caillat et al. ..... 418/55.6
5,775,894 A 7/1998 Kosco, Jr. ..... 418/63
5,810,572 A 9/1998 Yamamoto et al. ..... 418/55.6
5,829,959 A 11/1998 Tsubono et al. ..... 418/55.5
5,863,190 A 1/1999 Yamamoto et al. ..... 418/55.1
5,913,892 A 6/1999 Kwon ..... 62/269
5,931,649 A 8/1999 Caillat et al. ..... 418/55.1
5,931,650 A 8/1999 Yasu et al. ..... 418/55.3
5,947,709 A 9/1999 Koyama et al. ..... 418/55.6
5,964,581 A 10/1999 Iizuka et al. ..... 417/410.3
6,000,917 A 12/1999 Smerud et al. ..... 417/368
6,011,336 A 1/2000 Mathis et al. ..... 310/91
6,027,321 A 2/2000 Shim et al. ..... 418/1
6,039,551 A 3/2000 Takeuchi et al. ..... 418/88
6,050,794 A 4/2000 Noboru et al. ..... 418/55.6
6,056,523 A 5/2000 Won et al. ..... 418/15
6,106,254 A 8/2000 Hirooka et al. ..... 418/55.6
6,132,191 A 10/2000 Hugenroth et al. ..... 418/55.1
6,139,291 A 10/2000 Perevozchikov ..... 418/55.1
6,156,106 A 12/2000 Kamata ..... 96/189
6,162,035 A 12/2000 Hayano et al. ..... 418/220
6,167,719 B1 1/2001 Yakumaru et al. ..... 62/468
6,171,076 B1 1/2001 Gannaway ..... 417/350
6,179,589 B1 1/2001 Bass et al. ..... 418/55.1
6,186,753 B1 2/2001 Hugenroth et al. ..... 418/55.1
6,224,356 B1 5/2001 Dewar et al. ..... 418/55.1
6,227,830 B1 5/2001 Fields et al. ..... 418/55.1
6,247,910 B1 6/2001 Yokoyama
6,261,073 B1 7/2001 Kumazawa ..... 418/63
6,264,446 B1 7/2001 Rajendran et al. ..... 418/55.6
6,280,154 B1 * 8/2001 Clendenin et al. ..... 417/410.5
6,299,423 B1 10/2001 Perevozchikov ..... 418/55.1
6,305,912 B1 10/2001 Svendsen et al. ..... 417/312
6,402,485 B1 6/2002 Hong et al. ..... 417/366
2001/0006603 A1 7/2001 Hong et al. ..... 418/55.1
2001/0055536 A1 12/2001 Bernardi et al. ..... 418/55.6

FOREIGN PATENT DOCUMENTS

JP 61087994 5/1986
JP 402061382 A 3/1990
JP 05288171 A 11/1993
JP 407259764 A 10/1995
JP 09-032752 2/1997
JP 10-061567 3/1998
JP 10148191 A 6/1998
JP 2000-205152 7/2000
JP 2001020881 A 1/2001
JP 2001271752 A 10/2001
JP 2002021729 A 1/2002
JP 2002098056 A 4/2002

* cited by examiner

COMPRESSOR HAVING ALIGNMENT BUSHINGS AND ASSEMBLY METHOD

CROSS REFERENCE TO RELATED APPLICATIONS

This application claims priority under 35 U.S.C. 119(e) of U.S. provisional patent application Ser. No. 60/412,868 filed on Sep. 23, 2002 entitled COMPRESSOR HAVING ALIGNMENT BUSHINGS AND ASSEMBLY METHOD the disclosure of which is hereby incorporated by reference.

BACKGROUND OF THE INVENTION

1. Field of the Invention

The present invention relates to hermetic compressor assemblies, and in particular to means and methods related to their assembly.

2. Description of the Related Art

It is known in the art to subassemble portions of a hermetic compressor assembly prior to installing the compressor mechanism and electric motor in the shell or housing which encloses them. Often, portions of the compressor mechanism and motor are combined into what may be referred to as a compressor/motor subassembly, this subassembly being installed as a unit into the compressor shell wherein it may be fitted to other components separately installed in the compressor shell. Such separately installed components may include, for example, an outboard bearing which supports the free end of a drive shaft driven by the motor rotor. Alternatively, the subassembly may itself include substantially all internal components of the hermetic compressor assembly. After the compressor/motor subassembly is installed into the shell and fitted with other internal components, if any, the shell is hermetically sealed.

One concern associated with assembling the separate components or subassemblies of a hermetic compressor is maintaining proper alignment between components, particularly those components which move relative to one another or which determine their alignment. This problem may be particularly acute in cases where compressor components are separately installed into, and fixed to, the compressor shell, and complex assembly and/or welding jigs must often be employed to provide dimensional control and ensure proper alignment is maintained throughout the assembly process. Often, these jigs rely on an operator for proper placement, which may lead to component misalignment and other errors during the manufacturing process. Further, tolerance stackups between numerous interfitting components may contribute to their relative misalignments. Additionally, the separate installation of compressor components, and of placing and removing assembly and/or welding jigs, is time-consuming and often expensive.

Means and methods for improving the assembly process and the quality of the compressor assembly are therefore desirable. In particular, means and methods for improving alignment between the components of a compressor assembly or compressor/motor subassembly, while simplifying and rendering the assembly process less expensive, are desirable.

SUMMARY OF THE INVENTION

The present invention provides an improved compressor and method of assembling the compressor that includes the use of alignment guides to facilitate the precise assembly of a compressor/motor subassembly. The present invention also provides a method of mounting a compressor/motor subassembly within a compressor housing.

The invention comprises, in one form thereof, a method of assembling a compressor which includes providing a motor having a stator and a rotor and operably coupling a shaft with the rotor. The method also includes aligning a first bearing support member with the stator by registering at least one first alignment guide with at least one of the first bearing support member and the stator and securing the aligned first bearing support member with the stator wherein the first bearing support member rotatably supports the shaft proximate a first end of the motor. The method also includes aligning a second bearing support member with the stator by registering at least one second alignment guide with at least one of the second bearing support member and the stator and securing the aligned second bearing support member with the stator wherein the second bearing support member rotatably supports the shaft proximate a second end of the motor opposite the first end of the motor. A compressor mechanism is operably engaged to the shaft. The operably engaged compressor mechanism is secured relative to the motor, the shaft and the first and second bearing support members wherein the motor, the shaft, the first and second bearing support members and the compressor mechanism form a compressor subassembly. The method also includes inserting the compressor subassembly into a housing and hermetically sealing the housing after inserting the compressor subassembly therein.

The first and second alignment guides may be substantially cylindrical-shaped members wherein the steps of aligning the first and second bearing support members with the stator includes registering the first alignment guides with openings located on both the stator and the first bearing support member and registering each of the second alignment guides with openings located on both the stator and the second bearing support member. The first and second alignment guides may also define passageways extending through the cylindrical-shaped members and securing the aligned first and second bearing supports with the stator includes inserting a fastener through the passageways defined by the first and second alignment members.

Inserting the compressor subassembly into a housing may include thermally expanding the housing, inserting the compressor subassembly into the thermally expanded housing and securing said compressor subassembly within the housing by allowing the housing to contract and securely engage the compressor subassembly. The housing securely engages outwardly facing surfaces on said first and second bearing supports on said compressor subassembly.

In one embodiment, the compressor mechanism includes an orbiting scroll member and a fixed scroll member and the second bearing support includes a thrust surface wherein the orbiting scroll member is operably coupled with the shaft and positioned between the fixed scroll member and the thrust surface. Securing the compressor mechanism includes securing the fixed scroll to the second bearing support member.

The invention comprises, in another form thereof, a method of assembling a compressor assembly which includes providing a motor having a stator and a rotor and operably coupling a shaft to the rotor wherein the shaft defines a motor axis. The method also includes securing a first bearing support member to the stator in a predefined position wherein the first bearing support provides rotational support for the shaft proximate a first end of the motor and has a first radially outwardly disposed engagement surface. A second bearing support member is also secured to the stator in a predefined position wherein the second bearing support provides rotational support for the shaft proximate a second end of the motor opposite the first end and has a second radially outwardly disposed engagement surface. A compressor mechanism is operably coupled to the shaft. The operably engaged compressor mechanism is secured relative to the motor, the shaft and the first and second bearing support members wherein the motor, the shaft, the first and second bearing support members and the compressor mechanism form a compressor subassembly. The method also includes inserting the compressor subassembly in a thermally expanded housing and securing the compressor subassembly within the housing by allowing the housing to contract and securely engage the first and second engagement surfaces.

The first and second engagement surfaces may each be disposed radially outwardly by a greater distance than a radially outermost portion of the motor and wherein securing the compressor subassembly within the housing includes securing the first and second bearing supports and the motor within a substantially cylindrically shaped portion of the housing.

The present invention comprises, in yet another form thereof, a method of assembling a hermetic compressor assembly which includes forming a first pair of pilot openings in a first pair of mating surfaces of a crankcase and a motor stator and forming a second pair of pilot openings in a first pair of mating surfaces of the stator and a bearing support member. A first alignment guide is inserted into a first pilot opening of the first pair of pilot openings, the crankcase and stator are moved into proximity with each other and the first alignment guide is seated into a second pilot opening of the first pair of pilot openings to align the crankcase and the stator. A second alignment guide is inserted into a first pilot opening of the second pair of pilot openings, the stator and the bearing support member are moved into proximity with each other and the second alignment guide is seated into a second pilot opening of the second pair of pilot openings to align the stator and the bearing support member. The method also includes securing the stator to the crankcase and the bearing support member to the stator to form a subassembly wherein the crankcase, stator and bearing support member are maintained in alignment with each other.

The subassembly is then inserted into a housing and interior surfaces of the housing are brought into secure engagement with surfaces disposed on the crankcase and the bearing support member to fix the subassembly within the housing.

The invention comprises, in still another form thereof, a compressor assembly which includes a compression mechanism having a crankcase member with a main bearing and a plurality of first pilot openings. An electric motor including a stator and a rotor disposed within the stator is also provided. The stator is secured to the crankcase member and has a plurality of second pilot openings and a plurality of third pilot openings wherein each of the plurality of first pilot openings on the crankcase are aligned with one of said second pilot openings on the stator to form a plurality of pairs of aligned first and second pilot openings. A shaft is fixed to the rotor and is rotatably supported by the main bearing. The compression mechanism is operably coupled to the shaft. A first alignment guide is disposed within each pair of aligned first and second pilot openings whereby the alignment of the compression mechanism and stator is maintained. An outboard bearing support member is secured to the stator and has a plurality of fourth pilot openings. The motor is disposed between the compression mechanism and the outboard bearing support member with the shaft being rotatably supported by the outboard bearing support member. Each of the plurality of third pilot openings are aligned with one of the fourth pilot openings to form a plurality of pairs of aligned third and fourth pilot openings and a second alignment member is disposed within each pair of aligned third and fourth pilot openings whereby the alignment of the compression mechanism, the stator and the outboard bearing support member is maintained. A housing may also be provided wherein the compression mechanism, motor and outboard bearing are disposed within a housing with outward facing surfaces on the compression mechanism and outboard bearing support member securely engage interior surfaces of the housing.

An advantage of the present invention is that compressor build quality is improved vis-à-vis previous compressors by maintaining the compressor crankcase, stator and outboard bearing in proper alignment in a subassembly, the subassembly then being assembled without the need for tight tolerance controls within the compressor shell.

Another advantage is that all major internal components of the compressor assembly may be subassembled prior to introducing these components into the compressor shell, thereby facilitating good tool access and easier assembly of the compressor.

Yet another advantage is that the reliance upon assembly and welding jigs in manufacturing the compressor is minimized, thereby reducing assembly labor. Further, the potential for misassembly or misalignment of compressor components due to jig placement error is also minimized.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
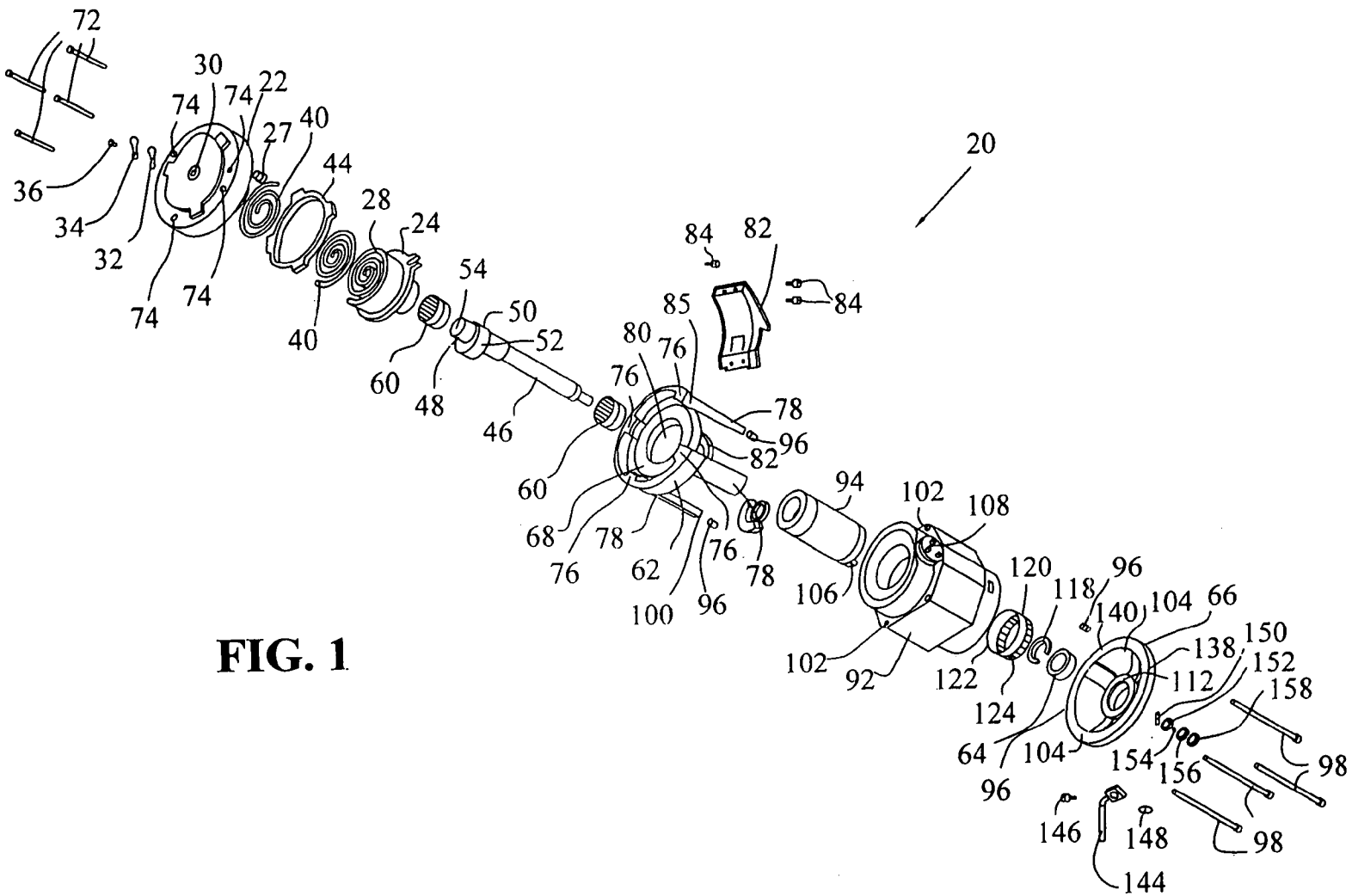
FIG. 1 is an exploded view of the internal components of a scroll compressor in accordance with the present invention.
Figure 2:
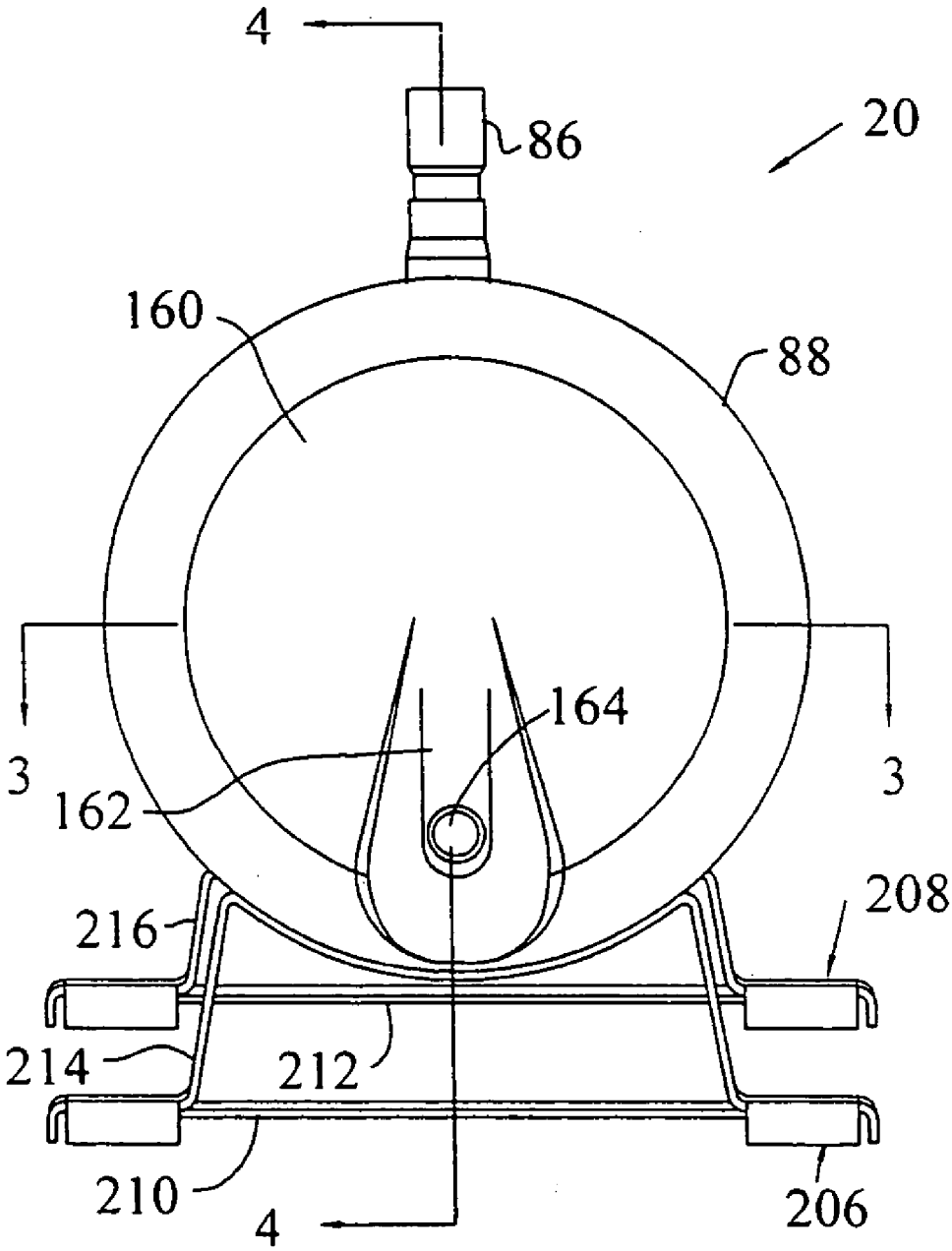
FIG. 2 is an end view of the compressor of FIG. 1.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DESCRIPTION OF THE PRESENT INVENTION

In accordance with the present invention, the internal components of scroll compressor 20 are shown in an exploded view in FIG. 1. Scroll compressor 20 includes a fixed or stationary cast iron scroll member 22 which is engaged with a cast iron orbiting scroll member 24. Fixed and orbiting scroll members 22, 24 respectively include an involute wrap 26, 28. A refrigerant is compressed between scroll members 22, 24 in pockets which are formed between involute wraps 26, 28 and which migrate radially inwardly as scroll member 24 orbitally moves relative to fixed scroll member 22. The refrigerant enters the space between the scroll members at low pressure through inlet 23 (FIG. 4) located at the radially outer portion of the space formed between scroll members 22, 24 and is discharged at a relatively high pressure through a discharge port 30 located proximate the radial center of fixed scroll member 22. Scroll members 22, 24 each have carbon steel tip seals 40 mounted in recesses located in the distal tips of involute wraps 26, 28, for providing a seal between involute wraps 26, 28 and the base plate of the opposing scroll member.

A one-way valve allows compressed refrigerant to be discharged into a discharge chamber or plenum 38 and prevents compressed refrigerant located in discharge plenum 38 from reentering discharge port 30. The valve includes an exhaust valve leaf 32 which sealingly engages fixed scroll member 22 at discharge port 30 and an exhaust valve retainer 34. Valve leaf 32 is secured between fixed scroll member 22 and valve retainer 34. Valve retainer 34 has a bend at its distal end which allows valve leaf 32 to flex outwardly away from discharge port 30 when gas is compressed between scroll members 22, 24 and thereby permit the passage of high pressure gas into discharge plenum 38. Valve retainer 34 limits the extent to which valve leaf 32 may flex outwardly away from discharge port 30 to prevent damage from excessive flexing of valve leaf 32. A threaded fastener 36 secures valve retainer 34 and valve leaf 32 to fixed scroll member 22. An alternative valve that may be used with compressor 20 is described by Haller et al. in U.S. Provisional Patent Application Ser. No. 60/412,905 entitled COMPRESSOR HAVING DISCHARGE VALVE filed on Sep. 23, 2002 which is hereby incorporated herein by reference. Pressure relief valve 27 is positioned between scroll members 22, 24 to allow discharge pressure gas to be directed into the suction pressure inlet in the event of overpressurization.

Oldham ring 44 is disposed between fixed scroll member 22 and orbiting scroll member 24 to control the relative motion between orbiting scroll member 24 and fixed scroll member 22. Orbiting scroll 24 is mounted on an eccentrically positioned extension or crankpin 48 of shaft 46 and rotation of shaft 46 imparts a relative orbital movement between orbiting scroll 24 and fixed scroll 22. The use of shafts having eccentrically positioned extensions and Oldham rings to impart a relative orbital motion between scroll members of a compressor is well known to those having ordinary skill in the art.

A counterweight 50 (FIG. 1) includes a collar portion with an opening through which shaft 46 is inserted. Counterweight 50 is not shown in FIGS. 3 and 4. Counterweight 50 also includes a partially cylindrical wall 52 which eccentrically loads shaft 46 to counterbalance the eccentric loading of shaft 46 by orbiting scroll 24. Counterweight 50 is heat shrink fitted onto shaft 46 in the illustrated embodiment. Shaft 46 includes an internal passageway 54 extending the longitudinal length of shaft 46 and secondary passages 56 extending transversely from passageway 54 to the radially outer surface of shaft 46. Passageways 54, 56 communicate lubricating oil between oil sump 58, which is located in the suction pressure chamber of the compressor housing, and bearings rotatably engaging shaft 46.

Two roller bearings 60 are positioned on shaft 46 where shaft 46 respectively engages orbiting scroll 24 and cast iron crankcase 62. A ball bearing 64 is positioned near the opposite end of shaft 46 and is mounted within cast aluminum outboard bearing 66. Shaft 46 may be supported in a manner similar to that described by Haller et al. in U.S. patent application Ser. No. 09/964,241 filed Sep. 26, 2001 entitled SHAFT AXIAL COMPLIANCE MECHANISM and which is hereby incorporated herein by reference.

A bearing support, i.e., crankcase 62, is secured to fixed scroll 22 with threaded fasteners 72 which pass through apertures 74 located in fixed scroll 22 and engage threaded bores 76 in crankcase 62. Crankcase 62 includes a thrust surface 68 which slidably engages orbiting scroll 24 and restricts movement of orbiting scroll 24 away from fixed scroll 22. Crankcase 62 also includes four legs 78 which secure the crankcase to stator 92 as described in greater detail below. Shaft 46 extends through opening 80 in crankcase 62. Crankcase 62 includes an integrally cast, substantially cup-shaped shroud portion 70 which is disposed between legs 78 in the lower portion of the horizontal compressor housing and partially encloses a space within which counterweight 50 rotates. Oil in sump 58 is prevented from flowing into this space by shroud portion 70. Shroud 70 includes an opening 81 along its upper portion which permits the equalization of pressure between the space partially enclosed by shroud 70 and the remainder of the low pressure chamber or plenum 39 of compressor 20. Low pressure plenum 39 includes that space within compressor housing 88 located between orbiting scroll 24 and end cap 168 and receives the suction pressure refrigerant which is returned to compressor 20 through inlet tube 86.

Figure 4:
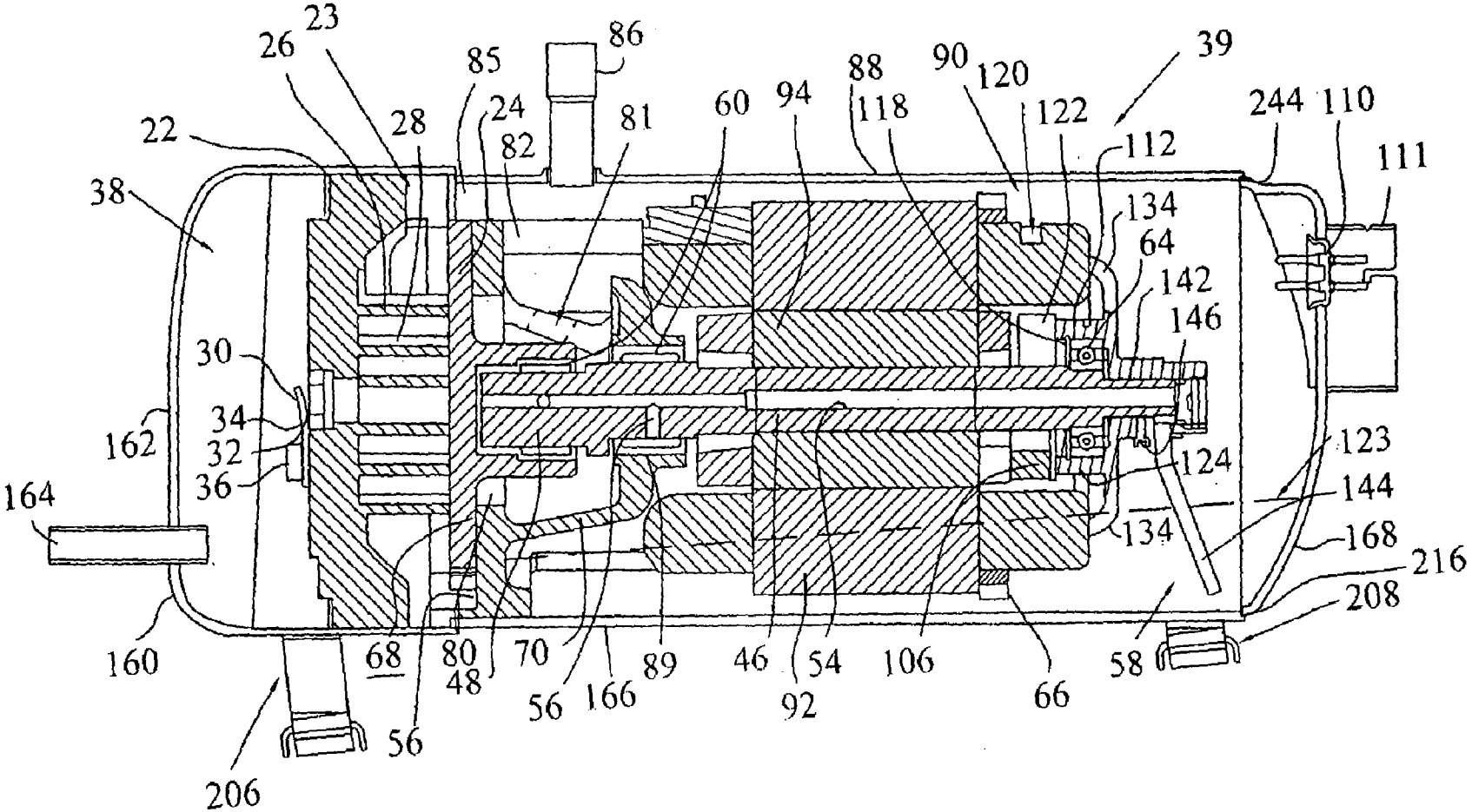
FIG. 4 is a sectional view of the compressor of FIG. 2 taken along line 4—4.

A suction baffle 82 (FIG. 1) is secured between two legs 78 using fasteners. The illustrated fasteners are socket head cap screws 84 but other fasteners such as self-tapping screws and other fastening methods may also be used to secure suction baffle 82. Suction baffle 82 is positioned proximate inlet tube 86 as best seen in FIG. 4. Refrigerant enters compressor housing 88 through inlet tube 86 and suction baffle 82 is positioned in the flow path of entering refrigerant to redirect the refrigerant along the outer perimeter of crankcase 62. As the inflowing suction pressure refrigerant gas and oil admixture impinges upon baffle 82, the oil is separated from the gas. The oil collects on the baffle and flows therealong, and along the surfaces of the crankcase, to the sump defined within the compressor shell. The outer perimeter of crankcase 62 includes a recess 85 adjacent suction baffle 82 which defines a passage to inlet 23. Crankcase 62 includes a sleeve portion 89 in which roller bearing 60 is mounted for rotatably supporting shaft 46. Sleeve 89 is supported by shroud portion 70 opposite opening 80. An alternative crankcase and suction baffle assembly many include an inlet to housing 88 located at mid-height wherein the suction baffle has a narrow opening located between inlet 86 and inlet 23 which extends transverse to the flow direction of refrigerant along the suction baffle to strip oil from the suction baffle. Crankcases and suction baffles which may be used with compressor 20 are described by Haller, et al. in the U.S. Provisional Patent Application Ser. No. 60/412,768 entitled COMPRESSOR ASSEMBLY filed on Sep. 23, 2002, the disclosure of which is hereby expressly incorporated herein by reference.

Figure 5:
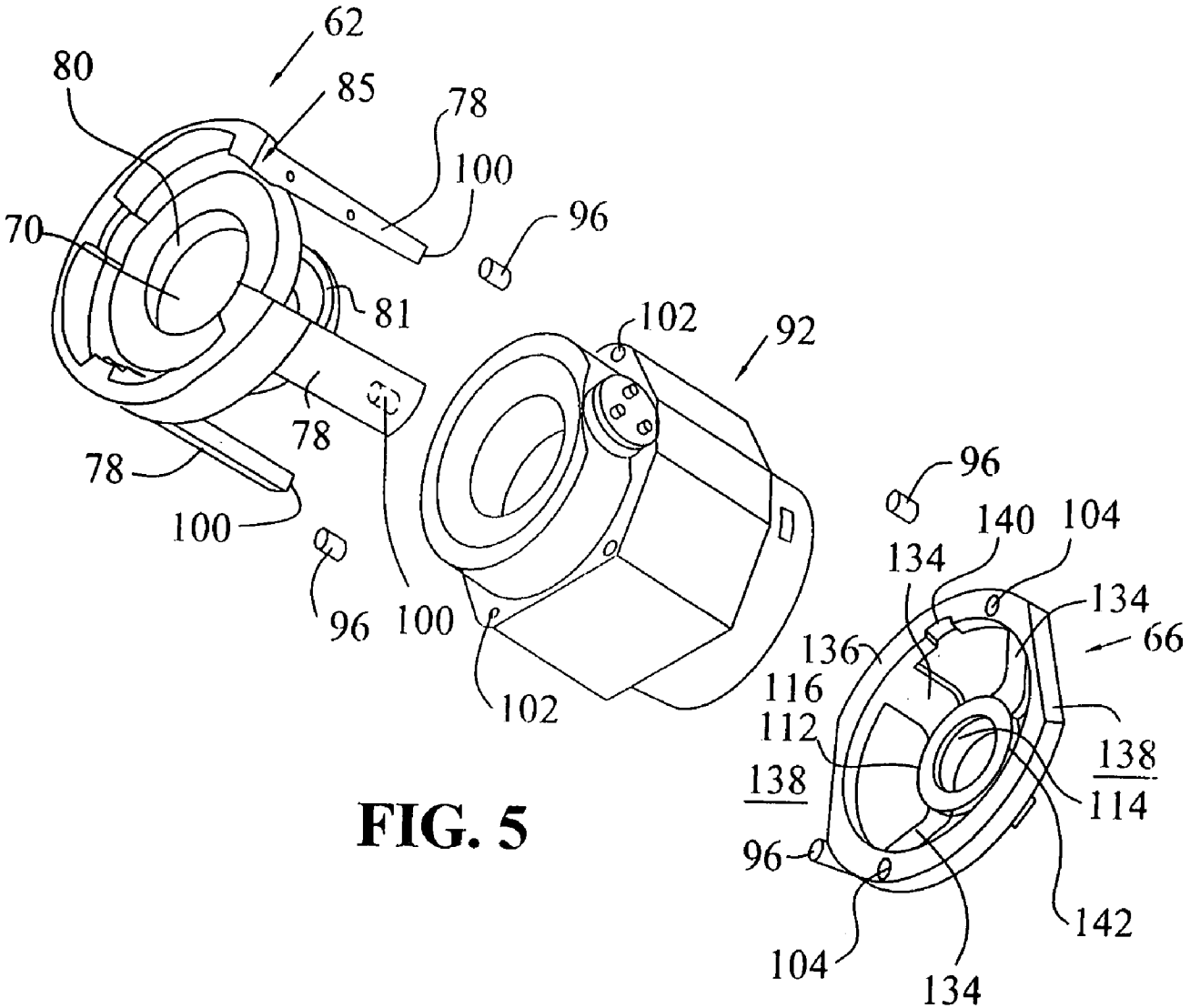
FIG. 5 is an exploded view of the crankcase, stator and outboard bearing of the compressor of FIG. 1.

A motor 90 is disposed adjacent crankcase 62 and includes a stator 92 and a rotor 94. Bushings or alignment members 96 are used to properly position stator 92 with respect to crankcase 62 and outboard bearing 66 when assembling compressor 20. During assembly, crankcase 62, motor 90 and outboard bearing 66 must have their respective bores through which shaft 46 is inserted precisely aligned. Smooth bore pilot holes 100, 102, 104 (FIG. 5) are precisely located relative to these bores in respectively abutting surfaces of crankcase 62, stator 92 and outboard bearing 66.

Pilot holes 100, 102 and 104 are centrally counterbored about bolt holes provided in the crankcase, stator and outboard bearing; that is, the axes of the bolt holes and pilot holes are substantially concentric with the smooth bore pilot holes having a relatively larger diameter. Cylindrical alignment bushings 96 slide tightly into the pilot holes to properly align crankcase 62, stator 92 and outboard bearing 66. Bolts 98 (FIG. 1) are then used to secure outboard bearing 66, stator 90 and crankcase 62 together after the compressor subassembly has been assembled. During subassembly of the motor/compressor unit, the complete compression mechanism, the suction baffle, the motor including the stator and rotor, the drive shaft, the outboard bearing, and all bearing components are assembled together, the proper alignment of the relatively moving parts being established and maintained by the engagement of the alignment members and the respective pilot holes. The subassembly is secured together by the crankcase, stator and outboard bearing being attached with bolts 98.

Pilot holes 100 are located in the distal end surfaces of crankcase legs 78, the bolt holes they are located about being threaded. Bolts 98 are threaded into these threaded holes in the crankcase when securing crankcase 62, stator 92 and outboard bearing 66 together during completion of the compressor subassembly. Pilot holes 102 are located in opposite ends of stator 92 and are counterbored about through holes which extend axially through stator 92 to allow the passage of bolts 98 therethrough. Through holes are provided in outboard bearing 66 also allow the passage bolts 98 therethrough, the heads of bolts 98 abutting the outboard bearing. Pilot holes 104 are provided about these bolt holes in the surface of the outboard bearing which abuts the adjacent axial surface of the stator.

In the disclosed embodiment, alignment guides or bushings 96 are hollow steel sleeves which may be rolled, cut from tubing, or machined, and bolts 98 are inserted therethrough once bushings 96 have been seated in their respective pair of pilot holes, and the compression mechanism, stator and outboard bearing fitted together. Alternative embodiments, however, could employ pilot holes and bushings to properly align crankcase 62, motor 90 and bearing support 66 with different methods of securing these parts together. For example, the pilot holes could be separate from the bolt holes through which bolts 98 are inserted or alternative methods of securing crankcase 62, motor 90 and bearing support 66 together could be employed with the use of pilot holes and alignment bushings 96. Further, should the pilot holes be located apart from the bolt holes, the alignment guides may be pins instead of hollow bushings as depicted in the drawings. Moreover, it is envisioned that the alignment guides may be formed by interfacing crankcase, stator and outboard bearing surfaces that are provided with complementary surface features which are interfitted to ensure proper alignment.

A terminal pin cluster 108 is located on motor 90 and wiring (not shown) connects cluster 108 with a second terminal pin cluster 110 mounted in end cap 168 and through which electrical power is supplied to motor 90. A terminal guard or fence 111 is welded to the exterior of end cap 168 and surrounds terminal cluster 110. Shaft 46 extends through the bore of rotor 94 and is rotationally secured thereto by a shrink fit whereby rotation of rotor 94 also rotates shaft 46. Rotor 94 includes a counterweight 106 at its end proximate outboard bearing 66.

As mentioned above, shaft 46 is rotatably supported by ball bearing 64 which is mounted in outboard bearing 66. Outboard bearing 66 includes a central boss 112 which defines a substantially cylindrical opening 114 into which ball bearing 64 is mounted. A retaining ring 118 is fitted within a groove 116 located in the interior of opening 114 to retain ball bearing 64 within boss 112. Oil shield 120 is secured to the exterior of boss 112 and has a cylindrical portion 122 which extends towards motor 90 therefrom. Counterweight 106 is disposed within the cylindrical space circumscribed by cylindrical portion 122 and is thereby shielded from the oil located in oil sump 58, although it is expected that the oil level 123 will be below oil shield 120 under most circumstances, as shown in FIG. 4. By preventing oil within the oil sump 58 from being brought into contact with counterweight 106, oil shield 120 prevents the counterweight 106 from contacting and agitating the oil in sump 58. A second substantially cylindrical portion 124 of oil shield 120 has a smaller diameter than the first cylindrical portion 122 and has a plurality of longitudinally extending tabs. The outer cylindrical surface of boss 112 includes a circular groove and oil shield 120 is secured to boss 112 by engaging the radially inwardly bent distal portions with the circular groove. An oil shield of this type is described by Skinner in the U.S. Provisional Patent Application Ser. No. 60/412,838 entitled COMPRESSOR HAVING COUNTERWEIGHT SHIELD filed on Sep. 23, 2002, the disclosure of which is hereby expressly incorporated herein by reference.

Support arms 134 extend between boss 112 and outer ring 136 of outboard bearing 66. The outer perimeters of ring 136 and of crankcase 62 are each provided with surfaces which contact the interior surface of the central cylindrical shell portion to affix the compressor subassembly to the compressor housing, as described further below. Two flat portions 138 are located at diametrically opposite locations on the outer perimeter of ring 136, thereby defining clearances between the outboard bearing and the interior surface of the cylindrical shell portion. Each flat portion 138 has a generally horizontal orientation, that is, one flat portion is located in the uppermost portion of the horizontal compressor housing, and the other flat portion is located in the lowermost portion of the compressor housing, in oil sump 58. Uppermost flat portion 138 facilitates the equalization of pressure within the suction plenum by allowing refrigerant to pass between outer ring 136 and housing 88. Lowermost flat portion 138 allows oil in oil sump 58 to pass between outer ring 136 and housing 88. A notch 140 located on the interior perimeter of outer ring 136 may be used to locate outboard bearing 66 during its machining and also facilitates the equalization of pressure within suction plenum 39 by allowing refrigerant to pass between stator 92 and outer ring 136. The outer perimeter of stator 92 also includes flats to provide passages between stator 92 and housing 88 through which lubricating oil and refrigerant may be communicated.

Support arms 134 are positioned such that the two lowermost arms 134 form an angle of approximately 120 degrees to limit the extent to which the two lowermost arms 134 extend into the oil in sump 58 and thereby limit the displacement of oil within oil sump 58 by such arms 134. A sleeve 142 projects rearwardly from bearing support 66 and provides for uptake of lubricating oil from oil sump 58. An oil pick up tube 144 is secured to sleeve 142 with a threaded fastener 146. An O-ring 148 provides a seal between oil pick up tube 144 and sleeve 142. As shown in FIG. 1, secured within a bore in sleeve and positioned near the end of shaft 46 are vane 150, reversing port plate 152, pin 154, washer and wave spring 156, and retaining ring 158 which facilitate the communication of lubricating oil through sleeve 112. Although appearing as one part in FIG. 1, washer and wave spring 156 are two separate parts wherein the washer is a flat circular part which does not include a central opening while the wave spring is formed from a sheet material and has a circular outer perimeter and central opening and circumferentially extending undulations. Such washers and wave springs are known in the art. A bearing support which may be used with compressor 20 is described by Haller in the U.S. Provisional Patent Application Ser. No. 60/412,890 entitled COMPRESSOR HAVING BEARING SUPPORT filed on Sep. 23, 2002, the disclosure of which is hereby expressly incorporated herein by reference. The bearing support may also include one or more circumferentially spaced recesses in the surface of the outer ring which bears against the stator whereby any bulges in the laminations of the stator caused by the securing of the bearing support against the stator may project into the recesses. The use of such recesses is described by Skinner et al. in U.S. patent application Ser. No. 10/617,475 entitled BEARING SUPPORT AND STATOR ASSEMBLY FOR COMPRESSOR which is hereby incorporated herein by reference.

Figure 3:
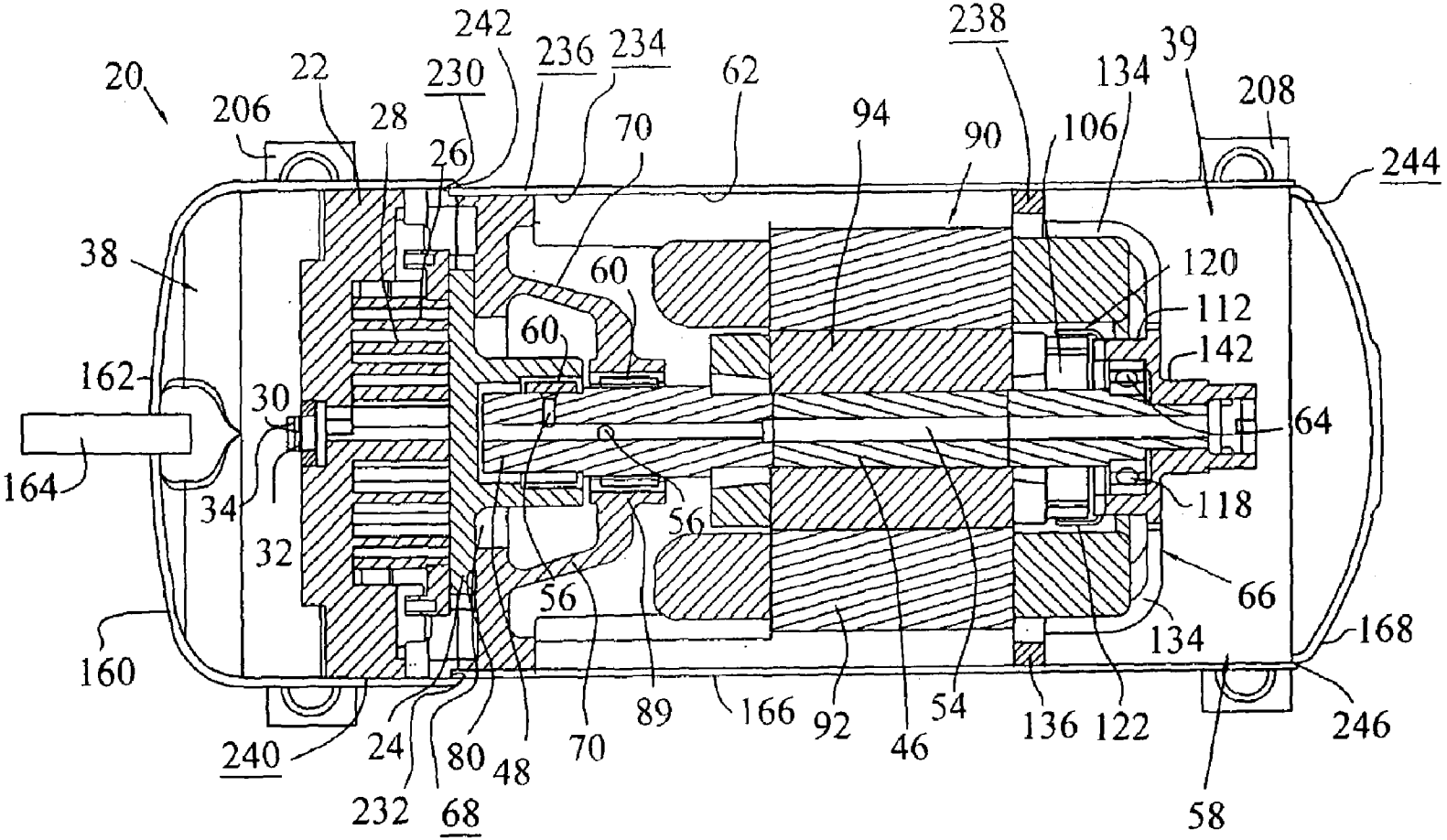
FIG. 3 is a sectional view of the compressor of FIG. 2 taken along line 3—3.

As best seen in FIG. 3, the compressor/motor subassembly is slid into heat-expanded, cylindrical, steel shell portion 166 of housing 88 until annular axial end surface 230 of shell portion 166 abuts annular step 232 machined onto crankcase 62. As cylindrical shell portion 166 cools, its interior cylindrical surface 234 contacts and compressively engages interfacing surfaces 236 and 238 of crankcase 62 and outboard bearing 66, respectively. Surfaces 236 and 238 may be circumferentially continuous or segmented, but each define a cylinder. This interference fit holds the compressor subassembly in place relative to the hermetic shell of the compressor assembly. No complex jigs are needed to orient cylindrical shell portion 166 and the compressor subassembly.

As can be seen in FIGS. 3 and 4, compressor housing 88 also includes a discharge end cap 160 having a relatively flat portion 162, and rear end cap 168. Steel end caps 160, 168 are welded to cylindrical shell portion 166 to provide a hermetically sealed enclosure. Notably, discharge end gap 160 is slid over cylindrical surface 240 until the annular open end surface thereof is approximately aligned with step 232 formed in crankcase 62. Weld 242 is then applied, the circular weld locally securing cylindrical shell portion 166, crankcase 62 and discharge end cap 160 and sealing the joint. Annular step 244 may be formed in the opposite end surface of shell portion 166, into which is fitted the annular open end of rear end cap 168. Circular weld 246 seals this joint.

A discharge tube 164 extends through an opening in flat portion 162. The securement of discharge tube 164 to end cap 160 by welding or brazing is facilitated by the use of flat portion 162 immediately surrounding the opening through which discharge tube 164 is positioned. Discharge tube 164 extends into discharge chamber 38 at a height from the lowermost portion of the chamber which minimally limits the amount of oil which may be captured in the chamber. As compressed refrigerant is discharged through discharge port 30 it enters discharge plenum 38 and is subsequently discharged from compressor 20 through discharge tube 164. Compressed refrigerant carries oil with it as it enters discharge plenum 38. Some of this oil will separate from the refrigerant and accumulate in the bottom portion of discharge plenum 38. Discharge tube 164 is located near the bottom portion of discharge plenum 38 so that the vapor flow discharged through tube 164 will carry with it oil which has settled to the bottom portion of discharge plenum 38 and thereby limit the quantity of oil which can accumulate in discharge plenum 38. Although the disclosed embodiment utilizes a short, straight length of tubing to provide discharge tube 164, alternative embodiments of the discharge outlet may also be used. A discharge plenum configuration which may be used with compressor 20 is described by Skinner in the U.S. Provisional Patent Application Ser. No. 60/412,871 entitled COMPRESSOR DISCHARGE ASSEMBLY filed on Sep. 23, 2002 which is hereby incorporated herein by reference.

Mounting brackets 206 and 208 are welded to housing 88 and support compressor 20 in a generally horizontal orientation. As can be seen in FIG. 4, however, mounting brackets 206, 208 have legs which differ in length such that the axis of shaft 46 defined by passage 54 while substantially horizontal will be positioned at an incline. The configuration of brackets 206, 208 are such that the portion of low pressure plenum 39 positioned below bearing support 66 and which defines oil sump 58 will be the lowermost portion of compressor 20. Bottom brace members 210, 212 may be secured to support members 214, 216 by a swaging operation. The mounting brackets used with compressor 20 may be those described by Skinner in the U.S. Provisional Patent Application Ser. No. 60/412,884 entitled COMPRESSOR MOUNTING BRACKET AND METHOD OF MAKING filed on Sep. 23, 2002, the disclosure of which is hereby expressly incorporated herein by reference. Alternative mounting brackets may also be employed. For example, mounting brackets formed by support members similar to members 214 and 216 but which have been given greater rigidity by bending their outer edges downward along the full length of the support members may be used without a crossbrace to support compressor 20. Resistance weld projections (not shown) may be formed in the cylindrical surfaces of support members 214, 216 which interface with the outer cylindrical surface of central shell portion 166.

While this invention has been described as having an exemplary design, the present invention may be further modified within the spirit and scope of this disclosure. This application is therefore intended to cover any variations, uses, or adaptations of the invention using its general principles.

What is claimed is:

1. A method of assembling a compressor, said method comprising:

providing a motor having a stator and a rotor;

operably coupling a shaft with said rotor;

aligning a first bearing support member with said stator by registering at least one first alignment guide with at least one of said first bearing support member and said stator, securing said aligned first bearing support member with said stator wherein said first bearing support member rotatably supports said shaft proximate a first end of said motor;

aligning a second bearing support member with said stator by registering at least one second alignment guide with at least one of said second bearing support member and said stator;

securing said aligned second bearing support member with said stator wherein said second bearing support member rotatably supports said shaft proximate a second end of said motor opposite said first end;

operably engaging a compressor mechanism to said shaft;

securing said operably engaged compressor mechanism relative to said motor, said shaft and said first and second bearing support members wherein said motor, said shaft, said first and second bearing support members and said compressor mechanism form a compressor subassembly;

inserting said compressor subassembly into a housing; and hermetically sealing said housing after inserting said compressor subassembly therein.

2. The method of claim 1 wherein said first and second alignment guides comprise substantially cylindrical-shaped members and wherein said steps of aligning said first and second bearing support members with said stator includes registering said first alignment guides with openings located on both said stator and said first bearing support member and registering each of said second alignment guides with openings located on both said stator and said second bearing support member.

3. The method of claim 2 wherein said first and second alignment guides define passageways extending through said cylindrical-shaped members and said steps of securing said aligned first and second bearing support members with said stator includes inserting a fastener through said passageways defined by said first and second alignment guides.

4. The method of claim 1 wherein said compressor mechanism includes an orbiting scroll member and a fixed scroll member and wherein said second bearing support includes a thrust surface; said orbiting scroll member operably coupled with said shaft and positioned between said fixed scroll member and said thrust surface.

5. The method of claim 4 wherein said step of securing said compressor mechanism includes securing said fixed scroll to said second bearing support member.

6. The method of claim 1 wherein said step of inserting said compressor subassembly into said housing comprises thermally expanding said housing, inserting said compressor subassembly into said thermally expanded housing and securing said compressor subassembly within said housing by allowing said housing to contract and securely engage said compressor subassembly.

7. The method of claim 6 wherein said housing securely engages outwardly facing surfaces on said first and second bearing support members on said compressor subassembly.

8. The method of claim 1 wherein said first and second alignment guides define passageways extending therethrough and the steps of securing said first and second bearing support members to said stator comprises inserting fasteners through said passageways of said first and second alignment guides.

9. The method of claim 1 wherein said stator defines a plurality of openings extending therethrough and said steps securing said aligned first and second bearing support members includes inserting a fastener through each of said plurality of stator openings and wherein each of said fasteners engages each of said first and second bearing support members.

10. The method of claim 9 wherein said first and second alignment guides define passageways extending therethrough and the steps of aligning said first and second bearing support members with said stator includes registering said first and second alignment guides with said stator openings.

11. A method of assembling a compressor assembly, said method comprising:

providing a motor having a stator and a rotor;

operably coupling a shaft to said rotor, said shaft defining a motor axis;

securing a first bearing support member to said stator in a predefined position, said first bearing support member providing rotational support for said shaft proximate a first end of said motor, said first bearing support member having a first radially outwardly disposed engagement surface;

securing a second bearing support member to said stator in a predefined position, said second bearing support member providing rotational support for said shaft proximate a second end of said motor opposite said first end, said second bearing support member having a second radially outwardly disposed engagement surface;

operably coupling a compressor mechanism to said shaft;

securing said operably engaged compressor mechanism relative to said motor, said shaft and said first and second bearing support members wherein said motor, said shaft, said first and second bearing support members and said compressor mechanism form a compressor subassembly;

inserting said compressor subassembly in a thermally expanded housing; and securing said compressor subassembly within said housing by allowing said housing to contract and securely engage said first and second engagement surfaces.

12. The method of claim 11 wherein said first and second engagement surfaces are each disposed radially outwardly by a greater distance than a radially outermost portion of said motor and wherein securing said compressor subassembly within said housing includes securing said first and second bearing support members and said motor within a substantially cylindrically shaped portion of said housing.

13. The method of claim 11 wherein said step of securing said first bearing support member to said stator includes aligning said first bearing support member with said stator in said predefined position by registering at least one first alignment guide with at least one of said first bearing support member and said stator and wherein said step of securing said second bearing support member to said stator includes aligning said second bearing support member with said stator in said predefined position by registering at least one second alignment guide with at least one of said second bearing support member and said stator.

14. The method of claim 13 wherein each of said first and second alignment guides comprise substantially cylindrical-shaped members and wherein said steps of aligning said first and second bearing support members with said stator includes registering each of said first alignment guides with an opening located on said stator and an opening located on said first bearing support member and registering each of said second alignment guides with an opening located on said stator and an opening located on said second bearing support member.

15. The method of claim 14 wherein each of said first and second alignment guides define passageways extending through said cylindrical-shaped members and said steps of securing said aligned first and second bearing supports with said stator includes inserting a fastener through each of said passageways defined by said first and second alignment guides.

16. A method of assembling a hermetic compressor assembly, comprising:

forming a first pair of pilot openings in a first pair of mating surfaces of a crankcase and a motor stator;

forming a second pair of pilot openings in a first pair of mating surfaces of the stator and a bearing support member;

inserting a first alignment guide into a first pilot opening of the first pair of pilot openings;

moving the crankcase and the stator into proximity with each other and seating the first alignment guide into a second pilot opening of the first pair of pilot openings to align the crankcase and the stator;

inserting a second alignment guide into a first pilot opening of the second pair of pilot openings;

moving the stator and the bearing support member into proximity with each other and seating the second alignment guide into a second pilot opening of the second pair of pilot openings to align the stator and the bearing support member; and securing the stator to the crankcase and the bearing support member to the stator to form a subassembly wherein the crankcase, stator and bearing support member are maintained in alignment with each other.

17. The method of claim 16, further comprising:

inserting the subassembly into a housing; and bringing interior surfaces of the housing into secure engagement with surfaces disposed on the crankcase and the bearing support member to fix the subassembly within the housing.

18. A compressor assembly comprising:

a compression mechanism including a crankcase member having a main bearing and a plurality of first pilot openings;

an electric motor comprising a stator and a rotor disposed within said stator, said stator secured to said crankcase member and having a plurality of second pilot openings and a plurality of third pilot openings, each of said plurality of first pilot openings being aligned with one of said second pilot openings to form a plurality of pairs of aligned first and second pilot openings;

a shaft fixed to said rotor, said shaft rotatably supported by said main bearing, said compression mechanism operably coupled to said shaft;

a first alignment guide disposed within each said pair of aligned first and second pilot openings, whereby the alignment of said compression mechanism and stator is maintained;

an outboard bearing support member secured to said stator and having a plurality of fourth pilot openings, said motor disposed between said compression mechanism and said outboard bearing support member, said shaft rotatably supported by said outboard bearing support member, each of said plurality of third pilot openings being aligned with one of said fourth pilot openings to form a plurality of pairs of aligned third and fourth pilot openings; and a second alignment guide disposed within each said pair of aligned third and fourth pilot openings, whereby the alignment of said compression mechanism, said stator and said outboard bearing support member is maintained.

19. The compressor assembly of claim 18, further comprising a housing, said compression mechanism, said motor and said outboard bearing support member disposed within said housing, and wherein said compression mechanism and said outboard bearing support members include outward facing surfaces securely engaging interior surfaces of said housing.

* * * * *